US006179722B1

(12) United States Patent
Bond

(10) Patent No.: US 6,179,722 B1
(45) Date of Patent: Jan. 30, 2001

(54) PUTTING TRAINER FOR SPEED CONTROL

(76) Inventor: Thomas M. Bond, 64 N. Moger Ave., Mount Kisco, NY (US) 10549

( * ) Notice: Under 35 U.S.C. 154(b), the term of this patent shall be extended for 0 days.

(21) Appl. No.: 09/275,043

(22) Filed: Mar. 24, 1999

Related U.S. Application Data

(60) Provisional application No. 60/119,646, filed on Feb. 11, 1999.

(51) Int. Cl.[7] ..... A63B 69/36
(52) U.S. Cl. ..... 473/180
(58) Field of Search ..... 473/162, 163, 473/166, 180–182, 185, 194

(56) References Cited

U.S. PATENT DOCUMENTS 1,479,673 * 1/1924 Phelps ..... 473/185
2,473,680 6/1949 Farris .
2,938,729 * 5/1960 Billfaldt ..... 473/180
3,494,620 * 2/1970 Schmudde et al. ..... 473/180
3,561,765 2/1971 Dixon et al. .
4,728,106 * 3/1988 Shore ..... 473/180
4,826,174 5/1989 Hoyt, Jr. .
5,595,543 * 1/1997 Wolk ..... 473/162

* cited by examiner

*Primary Examiner*—Mark S. Graham
(74) *Attorney, Agent, or Firm*—Venable, Baetjer, Howard & Civiletti, LLP; Andrew C. Aitken

(57) ABSTRACT

A putting practice device for practicing the velocity of a putt which has a ramp section and two trough sections. A ball having a predetermined speed will travel up the ramp and fall into the first trough section. If the ball has insufficient velocity to climb a ridge which defines the rear of the trough, it will be momentarily retained in the first trough section and fed to a lateral side of the device. Balls traveling with greater velocity may pass over the ridge and enter a second trough area where they will be momentarily retained and fed to a lateral side of the device.

11 Claims, 2 Drawing Sheets

PUTTING TRAINER FOR SPEED CONTROL

The applicant claims the benefit of the U.S. Provisional Application No. 60/119,646 filed on Feb. 11, 1999.

BACKGROUND OF THE INVENTION

The present invention relates to a practice device for putting and, more particularly, a device for practicing controlling the speed of a putted golf ball. Most commercially available putting practice devices are primarily focused on improving a player's control over the direction or aim of the ball rather than on the control of the speed. There are few devices, if any, which focus the attention of a player on the velocity of the stroke. Despite these circumstances, the control of the velocity of a putted ball is of critical importance to consistent low scoring on the golf course and the ability to accurately control the speed of the putt is a principal factor which separates a golfer's ability to make two putts rather than three putts on the green.

Putting practice devices currently on the market frequently have impediments provided a short distance behind a target area which prevent a ball from traveling a significant distance beyond the cup or other target provided. For example, in one popular class of device which provides an automatic ball return, a backstop or impediment is provided behind a target area which simulates a cup. These prior art devices have a wide entry ramp area with a short upwardly sloped entrance which quickly peaks and then slopes downward to feed the balls to an automatic return area. A target area is visible to the player which is approximately the size of a regulation cup. The backstop, which is typically formed in the shape of an inverted wedge or chevron, has a height greater than the midpoint of a golf ball and will stop most putts regardless of the speed of the ball. In another conventional type of practice device a deep trough or backstop is provided around an elevated target area which prevents the balls from traveling further than a predetermined distance past a target cup. A gently sloped ramp is provided from the floor area to the elevated area. The elevated area is necessary to provide for the depth of the target cup. The use of troughs or backstop impediments in the prior art devices may conveniently stop golf balls but they provide very little feedback to the player relating to the speed of the ball. The feedback to the player with respect to the speed of the ball with respect to these device is virtually one dimensional because these devices provide essentially the same feedback to the golfer regardless of the speed that the ball encounters the impediment or trough. Devices having backstops are not designed to provide feedback with respect to the speed of the ball but rather focus the golfer's attention on the direction of the putt. Although impediments provide a useful function by maintaining the balls together so they can be conveniently retrieved, they are not designed to assist the golfer with practicing the pace or speed of the stroke. Although the use of a cup in a putting practice device provides some form of speed control, the devices are generally not optimized for the control of speed of the stroked ball and do not provide any feedback when the putt does not directly intercept the cup.

In any practice putting device it is desirable to clear the target area of previous shots so that a golfer can hit a multitude of practice strokes at a given target without having to clear away balls which have been previously putted. In addition to serving as physical obstacles, the presence of balls in the target area may also interfere with the concentration of the golfer.

Notwithstanding the lack of devices which provide training and feedback to the golfer relating to speed control, the control of speed of the ball is of critical importance to low scoring. Accordingly, it is an object of the invention to provide a golf putting practice device which provides feed back to the player relating to the speed or velocity of the ball. A further object of the invention is to provide a device which will clear a target area of balls therefore enabling a player to take a number of practice strokes without interference with previously putted balls.

BRIEF SUMMARY OF THE INVENTION

The present invention is a putting practice device designed for practicing control of the speed or velocity of the golf stroke, which is frequently referred to as touch. The invention incorporates a gently sloping entrance ramp followed by a series of parallel troughs separated by a low parallel ridge. The object of the practice device is to allow a golfer to practice putting a golf ball at a precise velocity, a velocity which allows a golf ball to travel to the top of the entrance ramp and then enter and momentarily remain in the first trough. In order to focus the golfer on the speed or velocity of the putt, no cup area or simulated cup target area is provided.

DETAILED DESCRIPTION OF THE INVENTION

Figure 1:
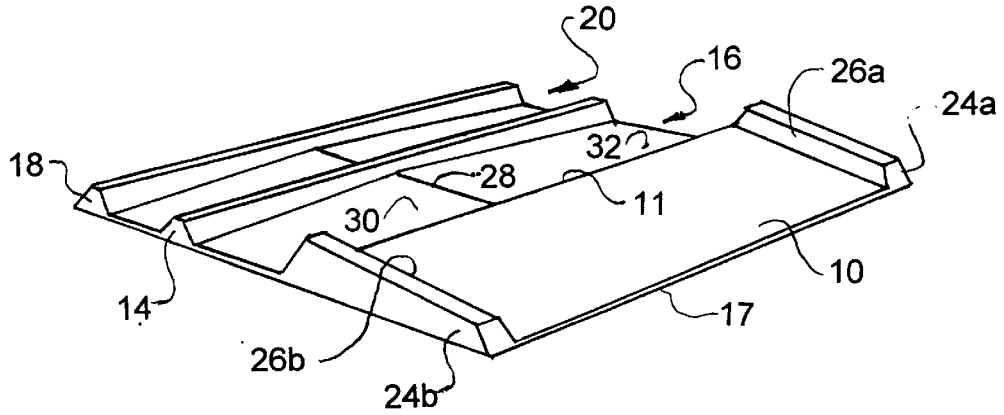
FIG. 1 is a perspective view of the putting practice device according to the invention.
Figure 2:
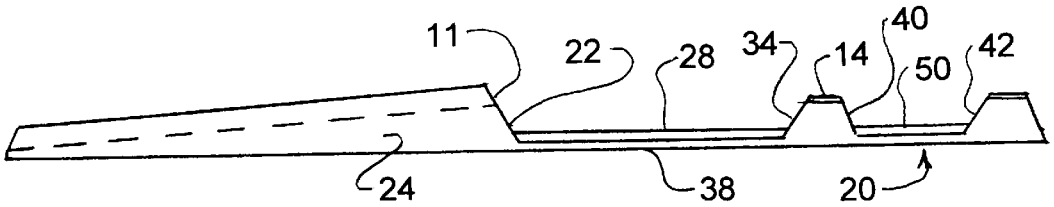
FIG. 2 is a side sectional view of the putting practice device according to the invention.
Figure 3:
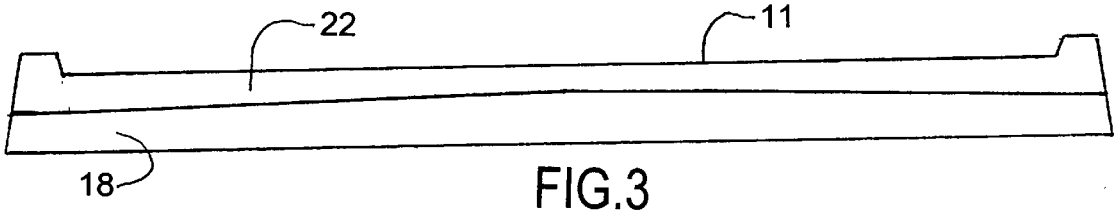
FIG. 3 is a rear view in elevation of the device according to the invention.
Figure 4:
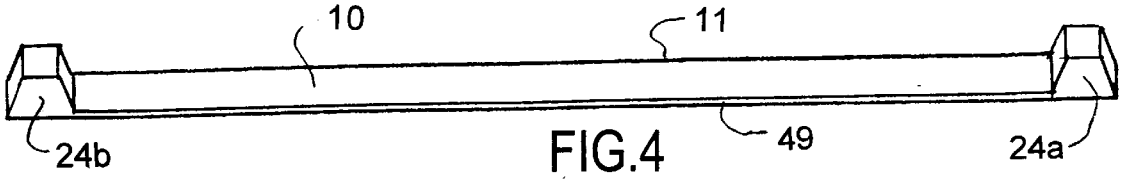
FIG. 4 is a front view in elevation view of the device according to the invention.
Figure 5:
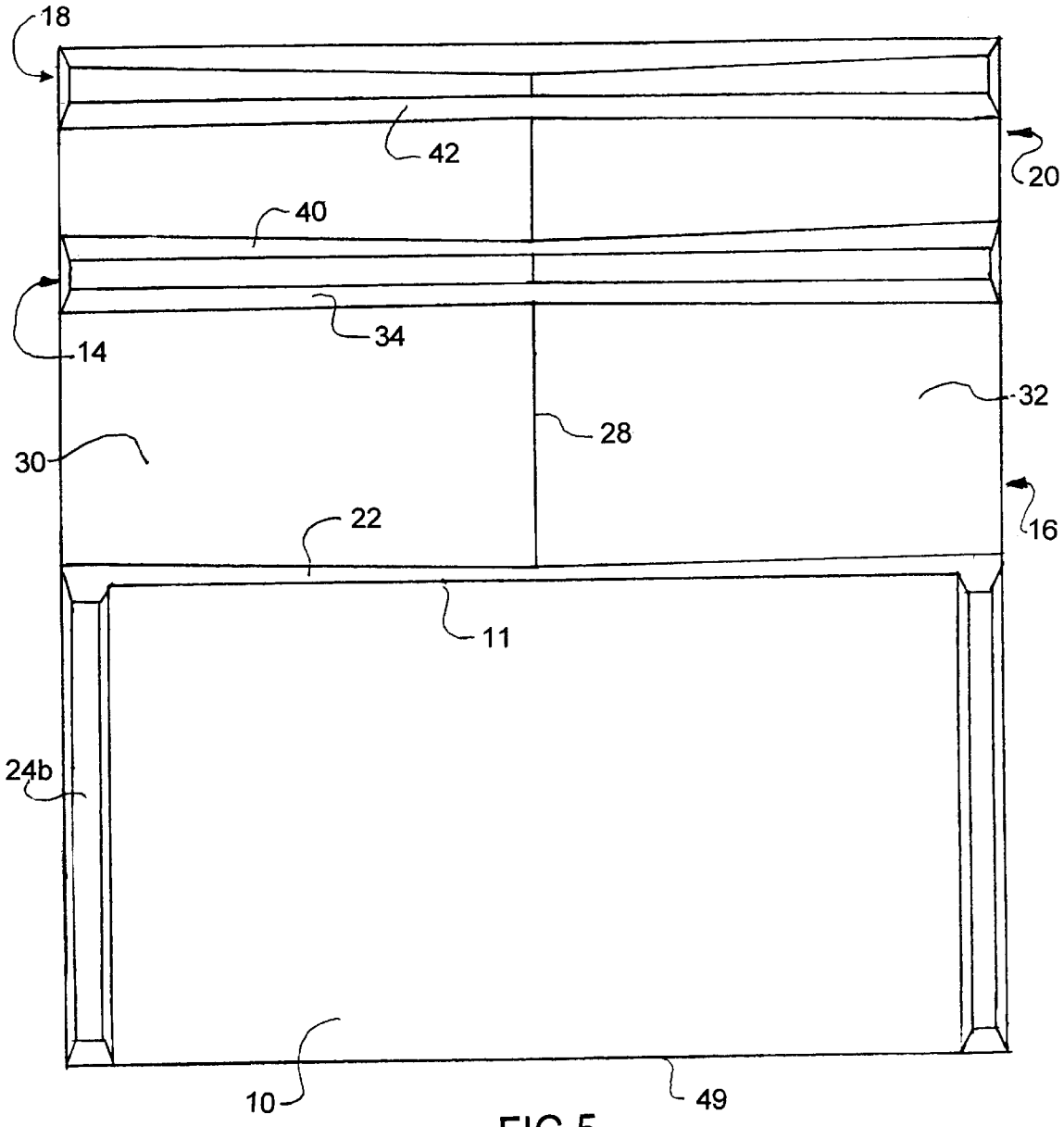
FIG. 5 is a top plan view of the device according to the invention.

Now referring to FIG. 1 the device according to the invention generally consists of a ramp section 10 and two trough sections 16 and 20. The device has a first ridge 14 and a second ridge 18 which define the two trough areas. The ramp section 10 is supported by back wall 22 and a pair of sidewalls 24*a* and 24*b* and has a relatively gentle slope. In the preferred embodiment, the angle between the ramp and the bottom of the device is approximately 4 degrees. The ramp rises from a height of zero, where the bottom of the ramp meets the floor along leading or entry edge 17, to a height of 0.44 inches at the ramp's trailing or exit edge 11 over a distance of approximately six inches. As best seen in FIG. 4, the leading or entry edge 17 in the preferred embodiment has a width of approximately 0.06 inches which equals the thickness of the material making up the device however it is also contemplated that it may be constructed to have a knife edge to allow a smooth transition from the floor to the ramp area. Ramp 10 has a length of approximately 6 inches and is approximately 12 inches wide. Sidewalls 24*a* and 24*b* support the lateral sides of the ramp and extend above the ramp area to form side rails 26*a* and 26*b*. The side rails guide a golf ball through the ramp area and prevent a ball from exiting the ramp on the said of the ramp. Now referring to FIG. 2, ramp 10 has a relatively steep drop from the trailing or exit edge 11 at back wall 22. Backwall 22 defines one side of first trough 16. In the preferred embodiment the angle defined by the back wall 22 of the ramp and the floor of the first trough is approximately 120 degrees. First trough 16 is defined by back wall 22, two opposite floor sections 30 and 32, and face 34 of first ridge 14. The floor sections 30 and 32 of the first trough meet at a peak 28 which is located at the center of the device and oriented perpendicular to the entry and exit edges. The floor sections slope downward from peak 28 to the lateral sides of the device in opposite directions. In the preferred embodiment the distance of the bottom of the first trough, measured from the bottom of back wall 22 to the bottom of face 34, is approximately 3.75 inches. The slope of the floor of the trough is provided for the purpose of clearing putted balls. The slope of the floor of the trough is defined by the peak 28 which rises 0.1 inches from the bottom surface 38 at the lateral side which is located approximately 6 inches away. Face 34 of first ridge 14 is planar and makes an angle with the floor of the first trough 16 of approximately 120 degrees. The angled face of the ridge 14 allows balls which are traveling at higher rates of speed to climb face 34 and pass over ridge 14. As best seen in FIG. 2, ridges 14 and 16 also have peaks at the center of the device and slightly slope from the center of the device to the opposite lateral sides. Accordingly, the height of face 34 remains fairly constant with respect to the floor of the trough. Maintaining this relationship fairly constant, which in the preferred embodiment is approximately 0.44 inches at the center and slightly shorter at the lateral sides, allows all putts which exit the ramp's trailing edge 11 and enter first trough 16 at similar speeds to exhibit similar results. The face is not exactly the same height to compensate for the lateral movement of the balls as they roll down the sloped floor of the trough toward the sides. In other words, a putt down the middle of the device will react in a similar manner to a putt traveling in a trajectory closer to a side rail. As best seen in FIG. 2 the profile of the ridges 14 and 18 is a trapezoid. In the preferred embodiment, the base of the trapezoid is approximately 0.88 inches long and the top of the trapezoid has a length of approximately 0.38 inches. Both the front and back faces of each of the ridges in the preferred embodiment have a slope of approximately 120 degrees with respect to the floor of the trough. In alternative contemplated embodiments, the profile of the ridge could be triangular, or a curved surface. If the height of the ridge was significantly diminished and the height allows golf balls which have different velocities to exhibit consistent behavior with regard to passing over the ridge or being blocked by the ridge, the device could be constructed with a ridge having a square profile.

Behind first trough 16 is second trough 20 which is defined by rear face 40 of first ridge 14 and a front face 42 of a second ridge 18. Second trough 16 is approximately 1.43 inches from the base of face 40 to the base of face 42 and also slopes from a center peak 50 toward the lateral sides like the first trough.

The device as constructed as described above provides meaningful feedback to the golfer relating to velocity of the ball. In operation, the device is preferably placed upon a carpeted floor with at least three feet of room in front of the device in which to putt. The objective of the device is to putt the ball so that it will travel up the ramp and enter and momentarily remain in the first trough. The entrance and exit areas to the ramp, which are parallel with each other and perpendicular to the path of the putted ball, provides a consistent feedback to the to the player regardless of the location where the putt enters the ramp. A golf ball having sufficient velocity to enter into the ramp area and travel over the trailing edge but with insufficient velocity to make it over the first ridge will accordingly be momentarily trapped within the first trough area. Because the floor of the trough area slopes toward the sides, golf balls which do not have sufficient velocity to travel over the ridge will then roll in a lateral direction and exit the side of the device. If a ball has sufficient velocity to climb the first ridge it enters into the second trough area. If the ball has insufficient velocity to climb the second ridge, the ball will momentarily remain in the second trough area and then exit to a lateral side. If the ball is traveling too rapidly, it will climb the second ridge and exit the rear edge of the device. The height and angles of the ridges as well as the length and angle of the ramp have been carefully developed to create a consistent performance. The gradual slope of the ramp has been selected so that its grade does not exceed those slopes typically found on a golf course greens and accordingly gives the golfer a natural feel.

The invention is to provide a practice device which is sensitive to the speed or velocity of the putt and which provides direct feedback to the golfer based upon where the ball travels and comes to rest. A device as constructed in accordance with the foregoing description can accordingly be used to practice putting the speed of the ball and can improve the touch of the golfer. Thus when a golfer hits the ball with a predetermine speed, positive feedback is provided to the golfer by visual inspection of the ball which will either be momentarily retained within a trough area (and then exit at a lateral side) or proceed over the ridges. Because balls within the troughs are fed to and out the lateral sides, the player can make a multiple number of shots without the need for clearing the balls from the target.

The side rails 12*a,* 12*b* keep the golf ball within the confines of the ramp area 10. In the preferred embodiment the device is formed from a single piece of synthetic resin and is manufactured so that multiple devices will nestle on top of one another for easy storage. Although the side rails in the preferred embodiment are integrally formed, it is contemplated that another arrangement may be provided such as parallel troughs. Although only a single trough is required to provide feedback to the golfer relating to the speed or velocity of the putt, in the preferred embodiment at least two troughs are provided to provide multiple feedback relating to the speed of the putt to the golfer. It is further contemplated that the device could be constructed with additional troughs to provide further feedback with respect to the speed of the ball. Although the preferred embodiment of the device involves the integration of a number of planar surfaces, it is contemplated that the device a also be constructed with continuously curved surfaces. For example, a sectional view of the profile of the ridges may be in the form of a bell curve and the troughs may have a u-shaped profile.

In the preferred embodiment the device does not incorporate a target or simulated cup in order to focus the golfer on the speed of the putt rather than on direction of the putt. In this regard, the only directional vector with which the player must be concerned is the relatively wide (12 inches), entrance to the ramp. This target should be relatively easy to hit by most golfers in most circumstances and consequently a player using the device is primarily concerned with the speed or velocity of the ball. By focusing and isolating the golfer's objective on this single element, the golfer can then practice this feature of the putting stroke and hopefully improve his or her touch. It is further contemplated that the surfaces of the device may be covered with a fabric, carpet or simulated grass to increase the friction on the surface on which the balls travel. In the event the surface is provided with alternative surfaces, it would be preferable to alter the dimensions of the features described in order to maintain analogous performance characteristics.

Having thus described the present invention and its preferred embodiment in detail, it will be readily apparent to those skilled in the art that further modifications to the invention may be made without departing from the spirit and scope of the invention as presently claimed.

I claim:

1. A putting practice device comprising a ramp section and a first trough section, said ramp section having an entry edge, an exit edge and a slope between said entry and exit edges, said entry edge substantially parallel with said exit edge, said first trough section adjacent to said ramp section and defined by an end wall of said ramp section, a first face of a first ridge and a first floor, said first face having a slope of more than 90 degrees with respect to said first floor and said first ridge having a peak positioned parallel with said exit edge of said ramp, said peak having a maximum elevation equal to or less than the height of said exit edge, said first floor having a maximum elevation less than the exit edge of said ramp, said first floor having a first floor peak located at a medial location on said first floor and, said first floor peak positioned perpendicular to said exit edge and said first floor having opposite floor areas sloping from said floor peak to opposite lateral sides of said device from said first floor peak wherein a golf ball which enters said first trough without sufficient velocity to exit said first trough over said ridge will roll to an opposite lateral side of the device and exit the device.

2. The device as recited in claim 1 wherein said entry edge and said exit edge are substantially parallel and form substantially straight lines.

3. The device as recited in claim 1 wherein said ramp section further comprises guide means on opposite lateral sides of said ramp section, and said guide means being contiguous with and extending upward from said ramp section.

4. The device as recited in claim 1 further comprising a second trough, said second trough, adjacent to said first trough and separated from said first trough by said first ridge, wherein said second trough is defined by a rear face of said first ridge, a second floor and a front fact of a second ridge, said second floor having a peak perpendicular to said first and second ridges and located at a medial location on said second floor and said second floor having a maximum height lower than the height of said first and second ridges, said second floor having opposite regions which slope to opposite lateral sides of said device, wherein a golf ball which enters said second trough area from a direction perpendicular to said first ridge that does not have sufficient velocity to exit said second trough over said second ridge will be momentarily retained within said second trough and then guided out one of the lateral sides of the device.

5. The device as recited in claim 1 wherein the profile of said ridge is formed by planar sidewalls having an angle with respect to the floor of the trough of greater than 90 degrees.

6. The device as recited in claim 1 wherein said first ridge has a maximum height with respect to said floor areas at said first floor peak and said height gradually diminishes as the ridge approaches said opposite lateral sides of said device allowing said putted golf balls to react fairly consistently regardless of the location a ball enters said ramp.

7. The device as recited in claim 3 wherein said guide means comprise raised side rails.

8. The device as recited in claim 1 further comprising a fabric covering such as synthetic grass or carpeting.

9. The device as recited in claim 1 wherein the ramp and a bottom of the device form an angle of approximately 4 degrees.

10. The device as recited in claim 1 wherein the slope of said ramp is constant between the leading edge and the trailing edge and said ramp defines a plane.

11. The device recited in claim 1 wherein multiple devices may be nested upon one another.

* * * * *